US009474317B2

(12) United States Patent
Berry

(10) Patent No.: US 9,474,317 B2
(45) Date of Patent: Oct. 25, 2016

(54) DUAL SHELL HELMET FOR MINIMIZING ROTATIONAL ACCELERATION

(71) Applicant: Bret Berry, Tallahassee, FL (US)

(72) Inventor: Bret Berry, Tallahassee, FL (US)

( * ) Notice: Subject to any disclaimer, the term of this patent is extended or adjusted under 35 U.S.C. 154(b) by 48 days.

(21) Appl. No.: 14/286,993

(22) Filed: May 24, 2014

(65) Prior Publication Data

US 2015/0089724 A1 Apr. 2, 2015

Related U.S. Application Data

(63) Continuation-in-part of application No. 14/044,357, filed on Oct. 2, 2013.

(51) Int. Cl.
*A42B 3/00* (2006.01)
*A42B 3/06* (2006.01)

(52) U.S. Cl.
CPC ..... *A42B 3/064* (2013.01)

(58) Field of Classification Search
CPC ..... A42B 3/125; A42B 3/12; A42B 3/063; A42B 3/064; A42B 1/064; A63B 71/10
USPC ..... 2/411, 412, 414, 413, 6.2
See application file for complete search history.

(56) References Cited

U.S. PATENT DOCUMENTS 3,906,546 A * 9/1975 Gooding ..... 2/414
5,204,998 A * 4/1993 Liu ..... A42B 3/121 2/411
2007/0190293 A1* 8/2007 Ferrara ..... B29C 45/0053 428/166
2011/0277221 A1* 11/2011 Ide et al. ..... 2/414
2012/0017358 A1* 1/2012 Princip ..... A42B 3/064 2/414
2012/0198604 A1* 8/2012 Weber et al. ..... 2/414
2012/0204328 A1* 8/2012 Emrich et al. ..... 2/411

FOREIGN PATENT DOCUMENTS

CA WO2012045169 * 4/2012 ..... A42B 3/12
DE 19961371 * 5/2001 ..... F41H 1/04

OTHER PUBLICATIONS

Foam Materials—EPP Foam—EPE Foam—EPS Foam. EFP Corporation. Web Nov. 19, 2012. Web. Retrieved Apr. 16, 2015. http://www.efpcorp.com/material-info.cfm.*
"EPS, What is EPS—Insulation Corporation of America". web retrieved Jul. 15, 2016. http://insulationcorp.com/eps/.*

* cited by examiner

*Primary Examiner* — Clinton T Ostrup
*Assistant Examiner* — Jillian K Pierorazio
(74) *Attorney, Agent, or Firm* — James M. Smedley LLC; James Michael Smedley, Esq.

(57) ABSTRACT

The present invention relates to personal safety equipment for use by athletes, military personnel, motor sports participants and the like and in particular, protective headgear adapted to minimize rotational acceleration and/or axial compressive forces incident on the head of a wearer.

9 Claims, 4 Drawing Sheets

DUAL SHELL HELMET FOR MINIMIZING ROTATIONAL ACCELERATION

CROSS-REFERENCE TO RELATED APPLICATIONS

The application is a continuation-in-part of U.S. Non-Provisional Utility patent application Ser. No. 14/044,357, filed Oct. 2, 2013, the entire disclosure of which is incorporated herein by reference.

FIELD OF THE INVENTION

The present invention relates to personal safety equipment for use by athletes, military personnel, motor sports participants and the like and in particular, protective headgear adapted to minimize rotational acceleration and/or axial compressive forces incident on the head of a wearer.

BACKGROUND OF THE INVENTION

There are many professions and activities in which participants may be exposed to physical contact which may result in head injury. For example, athletes participating in contact sports, such as American football, are subject to exposure to concussions, hyperextension, whiplash-type head movement, and cervical compressive forces. Football players at positions such as interior lineman, for example, are subjected to physical contact on virtually every play which can force the player's head rapidly backward, to create a whiplash effect which can result in serious and disabling injury. Additionally, it has recently been noted that glancing blows, or hits not directly on center, lead to concussions as well as torsional neck injury. Moreover, persons involved in activities such as high speed vehicle test piloting and race car driving can also be exposed to hyperextension or whiplash-type injuries caused by high rates of acceleration and impact forces. Military personnel are likewise exposed to combat and training situations which place them at risk of head injury. For participants in these and other activities, protective headgear such as helmets is often standard equipment.

Most blows to the head of participants in such activities are not direct, on-axis impacts, which cause linear acceleration. Generally, the blows to the head are glancing blows, with the head of a participant twisting as a result. Recent studies have shown that concussions are likely most often caused by rotational acceleration of the head, i.e., combined linear and angular acceleration.

Currently, the solution to prevent or minimize these injuries has simply been to add more padding to existing helmets. Some designs have added "crumple zones" to the exterior of the helmet, or a padded cap. These existing designs do not prevent or minimize the effects of glancing or off-center impacts which result in rotational acceleration.

Therefore, there is a need in the art for protective headgear which may reduce the likelihood of certain head and neck injuries, such as concussion, whiplash, and hyperextension of the neck. The presently disclosed subject matter provide a helmet which offers improved protection against head and neck injury as a consequence of rotational acceleration upon impact. These and other features and advantages of the present invention will be explained and will become obvious to one skilled in the art through the summary of the invention that follows.

SUMMARY OF THE INVENTION

In one aspect the presently disclosed subject matter relates to a protective helmet which employs an inner shell, an outer shell, and dampening elements positioned between the inner and outer shells which facilitate rotational movement between the inner and outer shells. The dampening elements, also referred to herein as dampeners, also provide shock absorption to counter the rotational acceleration caused by an impact to the helmet.

According to an embodiment of the present invention, a protective helmet comprises: an inner shell forming a first cavity adapted to receive a head of a wearer and comprising one or more dampener receiving points formed in the inner shell, an outer shell forming a second cavity adapted to receive the inner shell and comprising one or more attachment points dispersed on an interior surface of outer shell, wherein each of the attachment point corresponds to one of the dampener receiving points formed in the inner shell, and one or more dampener assemblies each individually extending through the inner shell at one of the dampener receiving points and comprising, a dampener, wherein a portion of the dampener extends between the inner shell and the outer shell to create a cushion between the inner shell and the outer shell, a dampener securing element movably engaged with the dampener to provide a pliable connection between the dampener securing element and the dampener, and a fastening means configured to affix the dampener securing element to one of the attachment points on the outer shell to allow rotational movement between the inner shell and the outer shell, wherein the rotational movement is facilitated by the cushion and the pliable connection, wherein the dampener assemblies compress to absorb an impact on the protective helmet.

According to an embodiment of the present invention, the one or more attachment points are posts extend from the interior surface of the outer shell.

According to an embodiment of the present invention, the one or more dampener assemblies are connected via a dampener assembly sleeve that fits inside the inner shell.

According to an embodiment of the present invention, the dampener is formed as a substantially ring-shaped pad with a center adapted to receive the dampener securing element.

According to an embodiment of the present invention, the dampener securing element is formed with a channel passing through the center of the dampener securing element.

According to an embodiment of the present invention, the inner shell is comprised of a foam inner liner and a durable outer shell.

According to an embodiment of the present invention, the foam inner liner is comprised of closed-cell foam.

According to an embodiment of the present invention, the durable outer shell is comprised of ABS plastic.

According to an embodiment of the present invention, the inner shell and the outer shell are removably fitted together.

According to an embodiment of the present invention, the protective helmet is further comprised of a protective accessory configured to protect wearer's face.

According to an embodiment of the present invention, the outer shell is further comprised of an accessory attachment means adapted to connect the protective accessory to an exterior surface of the outer shell.

According to an embodiment of the present invention, the protective accessory is a facemask.

According to an embodiment of the present invention, the protective accessory is a visor.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

For the purposes of illustration, there are forms shown in the drawings that are presently preferred, it being understood, however, that the invention is not limited to the precise arrangements and instrumentalities shown. In particular, while an embodiment representing a football helmet is shown, the protective helmet of the present invention may be configured for any number of applications including, but not limited to, motorsports and military applications.

DETAILED DESCRIPTION OF THE INVENTION

Figure 1:
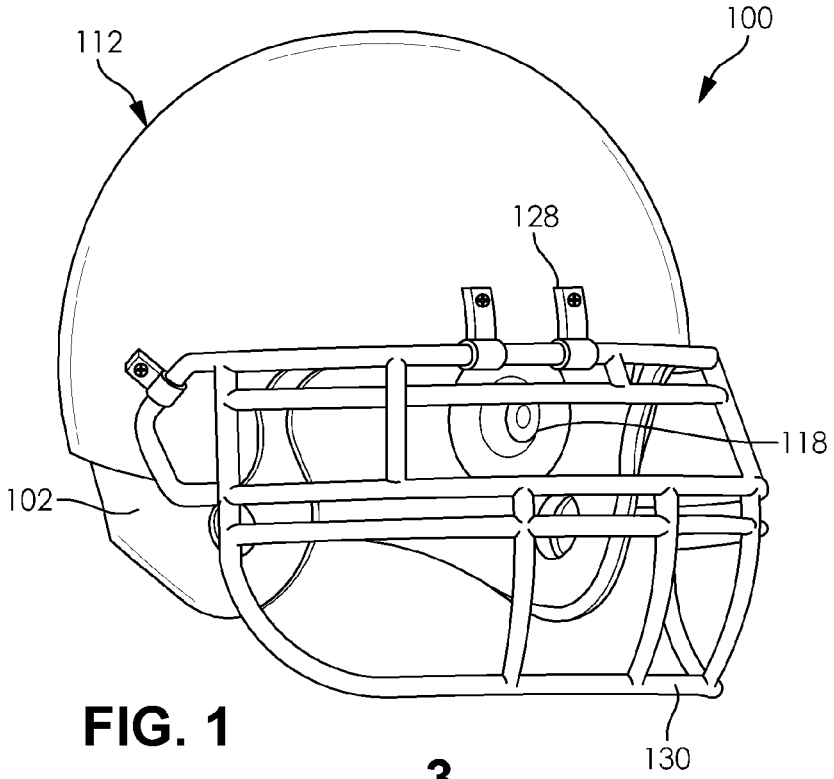
FIG. 1 is a front perspective view of a protective helmet in accordance with an embodiment of the present invention.

The present invention relates to personal safety equipment for use by athletes, military personnel, motor sports participants and the like and in particular, protective headgear adapted to minimize rotational acceleration and/or axial compressive forces incident on the head of a wearer.

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

According to an embodiment of the present invention, a protective helmet comprising an inner shell, an outer shell, and one or more dampener assemblies. In a preferred embodiment, the one or more dampener assemblies facilitate rotational movement between the inner and outer shells. The dampener assemblies may also provide shock absorption to counter the rotational acceleration caused by an impact to the helmet. Certain embodiments of the protective helmet may include fewer or additional components depending upon the particular application for which the protective helmet is intended. As an illustrative example, a protective helmet that is intended to be used as a football helmet may further include a facemask and a means for attaching the face mask to the outer shell of the protective helmet. One of ordinary skill in the art would appreciate the protective helmet could incorporate numerous components, and embodiments of the present invention are contemplated for use with any such component.

According to an embodiment of present invention, the protective helmet is comprised of an inner shell. In a preferred embodiment, the inner shell forms a cavity with an exterior surface and an interior surface. In the preferred embodiment, the interior surface of the cavity faces and receives the head of a wearer and is made from a closed-cell foam material, including but not limited to polystyrene. Other suitable materials may include cloth and rubber. Additionally, the exterior surface of inner shell is typically a thin durable coating, including but not limited to acrylonitrile butadiene styrene (ABS plastic). In the preferred embodiment, the closed-cell foam forms the core structure and the interior surface of the inner shell, while the thin plastic coating covers the outer surface of the closed-cell foam core, thereby forming the exterior surface of the inner shell. In alternate embodiments, interior and exterior surfaces of the inner shell may be assembled from alternate materials depending upon the intended application of the protective helmet. Other options for the coating of the inner shell include, but are not limited to, aramid fiber (e.g. KEVLAR® from DuPont), carbon fiber, polycarbonate, padded leather, and other nylon or plastic compounds. In some embodiments the inner shell may further include padding on its interior surface to cushion the wearer's head from direct blows and/or provide a comfortable and secure fit. Examples of such padding may include, but are not limited to, pads which are employed inside conventional, commercially-available helmets. The padding may be removable. The preferred embodiment of inner shell is further comprised of one or more dampener receiving points that are formed in the inner shell. One of ordinary skill in the art would appreciate that there are many suitable design for an inner shell of a protective helmet, and embodiments of the present invention are contemplated for use with any such design.

According to an embodiment of the present invention, pads may be employed on the interior surface of inner shell to cushion the wearer's head from direct blows and/or provide a comfortable and secure fit. Examples of suitable pads include pads which are employed inside conventional, commercially-available helmets. Examples of suitable pad materials include plastic, foam, viscoelastic polymer, rubber, silicone, gel filled pads, air-filled or air fillable pads, etc. The pads can be permanently attached or removable as is known in the art. Likewise, the pads can be a singular pad system, or a system of pads manufactured from various different materials known in the art.

According to an embodiment of the present invention, the inner shell of the protective helmet is further comprised of one or more dampener receiving points. In a preferred embodiment, the dampener receiving points are dispersed throughout the inner shell such the dampener receiving points extend from the interior surface of the inner shell through the exterior surface of the inner shell creating a series or arrangement of holes that perforate the inner shell.

One of ordinary skill in the art would appreciate that there are many possible designs and arrangements for the one or more dampener receiving points, and embodiments of the present invention are contemplated for use with any such design or arrangement.

According to an embodiment of the present invention, the protective helmet is comprised of an outer shell. In a preferred embodiment, the outer shell forms a cavity with an exterior surface and an interior surface. In the preferred embodiment, the interior surface of the cavity faces and receives the inner shell of the protective helmet. The outer shell may be suitably constructed from a variety of durable materials including, but not limited to, aramid fiber (e.g. KEVLAR® from DuPont), carbon fiber, polycarbonate, padded leather, and other nylon or plastic compounds. In the preferred embodiment, the outer shell is further comprised of one or more attachment points dispersed on the interior surface of the outer shell. In general, each of the attachment points will correspond to one of the dampener receiving points that is formed in the inner shell. In the preferred embodiment, the outer shell of the helmet may be further comprised of an accessory attachment means. One of ordinary skill in the art would appreciate that there are many suitable design and materials for an outer shell of a protective helmet, and embodiments of the present invention are contemplated for use with any such design or material.

According to an embodiment of the present invention, the outer shell of the protective helmet is further comprised of one or more attachment points. In a preferred embodiment, the attachment points are dispersed on the interior surface of the outer shell, with each attachment point corresponding to one of the dampener receiving points on the inner shell. In the preferred embodiment, the one or more attachment points are posts extending from the interior surface of the second shell and adapted to receive or otherwise connect with a fastening means. One of ordinary skill in the art would appreciate that there are many possible designs and arrangements for the one or more attachment points, and embodiments of the present invention are contemplated for use with any such design or arrangement.

According to an embodiment of the present invention, the outer shell of the protective helmet is further comprised of an accessory attachment means. In the preferred embodiment, the accessory attachment means is a connector or series of connectors on the outer shell that are configured to connect to and securely retain an accessory or similar item on the protective helmet. In alternate embodiments, the accessory attachment means may be configured on the inner shell. Connectors may include, but are not limited buttons, claps, clips, hook-and-loop fasteners, and snaps. One of ordinary skill in the art would appreciate that there are a number of suitable connectors that could be used as an accessory attachment means, and embodiments of the present invention are contemplated for use with any such connector.

According to an embodiment of the present invention, the protective helmet is further comprised of a protective accessory. In a preferred embodiment, the protective accessory may be configured to protect the face, neck, and other areas of the user's head that may not be fully covered by the protective helmet. In the preferred embodiment, protective accessory attaches to the outer shell of the protective helmet at the accessory attachment means. The protective accessory may be removable or a permanent structure of the protective helmet. In an alternate embodiment, the protective accessory may attach to alternate areas of the helmet, such as the inner shell or to alternate portions of the outer shell. Examples of protective accessories include, but are not limited to face-masks, chin straps, and visors. One of ordinary skill in the art would appreciate there are many types of and configurations for a protective accessory, and embodiments of the present invention are contemplated for use with any such protective accessory type and configuration.

According to an embodiment of the present invention, the protective helmet is further comprised of one or more dampener assemblies. In a preferred embodiment, the dampener assembly is comprised of a dampener, a dampener securing element, and a fastening means. Alternate embodiments of the dampener assembly may include fewer or additional components. In the preferred embodiment, one dampener assembly extends through the inner shell at each of the dampener receiving points. Each dampener assembly is adapted to help absorb an impact that is delivered to the protective helmet. In the preferred embodiment, each dampener assembly is unconnected to the other dampener assemblies in the protective helmet. In an alternate preferred embodiment, each of the dampener assemblies is connected to the other via a dampener assembly sleeve. That dampener assembly sleeve may be a liner or similar insert that links together each of the dampener assemblies and fits on the interior surface of the inner shell. Alternatively, the dampener assembly sleeve may connect the dampener assemblies by fitting between the exterior surface of the inner shell and the interior surface of the outer shell. One of ordinary skill in the art would appreciate there are many suitable designs for a dampener assembly, and embodiments of the present invention are contemplated for use with any such design.

According to an embodiment of the present invention, the dampener assembly includes a dampener. In a preferred embodiment, the dampener is a ring-shaped or toroidal (or at least substantially ring-shaped pad or substantially toroidal) pad with a center that is adapted to receive the dampener securing element. The center of the dampener may be configured as a hole or channel that passes through the middle of the dampener, with that hole or channel being adapted to receive the dampening securing element. The side walls of the hole or channel may be straight, creating a channel with parallel walls, or angled, creating a channel with walls that taper (or funnel) toward each other. In the preferred embodiment, each dampener extends through the inner shell at one of the dampener receiving points, such that the dampener substantially fills that dampener receiving point. Additionally, a portion of the dampener extends beyond the exterior surface of the inner shell. In the preferred embodiment, this extended portion of the dampener creates pliable cushion that provides separation between the exterior surface of the inner shell and the interior surface of the outer shell. In the preferred embodiment, the dampener may be made from a variety of materials, including, but not limited to, elastic polymers, viscoelastic gels, rubber compounds, and any suitable combination thereof. Those and similar materials permit the dampener to compress and elongate upon impact, permitting rotational and translational movement. One of ordinary skill in the art would appreciate there are many suitable designs and materials that could be used for a dampener, and embodiments of the present invention are contemplated for use with any such design or material.

According to an embodiment of the present invention, the dampener assembly includes a dampener securing element. In a preferred embodiment the dampener securing element is a plug, grommet, or similar fitting that is movably engaged with the hole in the center of the dampener. In the preferred embodiment, the dampener securing element allows for an elastic and adaptable connection to exist between the dampener securing element and the dampener. Materials for the dampener securing element include, but are not limited to, rubber, plastic, and other elastic or otherwise pliable materials. The dampener securing element may be of a shape that corresponds to the center of the dampener. As an illustrative example, if the center of the dampener has straight or parallel walls, then the dampener securing element will have straight sides. On the other hand, if the center of the dampener has tapered walls, the dampener securing element will have angled sides. In the preferred embodiment, the dampener securing element is formed with a channel passing through the center of the dampener securing element. This channel is adapted to receive the fastening means. In the preferred embodiment, the dampener securing element may be further formed with a cavity or similar hollow space to receive the attachment post of the attachment point. This feature would be helpful for aligning the dampener securing element with the attachment point and further to guide the fastening means through the dampener securing element and into the attachment point. One or ordinary skill in the art would appreciate that there are many suitable designs for a dampener securing element, and embodiments of the present invention are contemplated for use with any such design.

According to an embodiment of the present invention, the dampener assembly includes a fastening means. In a preferred embodiment, the fastening means is configured to affix the dampener securing element to one of the attachment points on the interior surface of the outer shell. When the dampener securing element is secured to the attachment point on the outer shell, the dampener securing element is held in place at the center of the dampener. In the preferred embodiment, this connection allows for rotational movement between the inner shell and the outer shell. This rotational movement is facilitated by the flexible connection between the dampener and the dampener securing element, as well as the cushion created by the portion of the dampener that is between the inner and outer shell. The connection between the dampener and the dampener securing element is flexible because at least one of those components is made of a resilient material. Likewise, the cushion created by the dampener between the outer shell and the inner shell is possible because of the resilient nature of the dampener. In the preferred embodiment, the fastening means may be a screw or similar fastener that securely connects the dampener securing element to the attachment point. One of ordinary skill in the art would appreciate that there a number of suitable fasteners that might be used as a fastening means, and embodiments of the present invention are contemplated for use with any type of fastener.

According to an embodiment of the present invention, the inner shell and the outer shell are removably fitted together. In a preferred embodiment, the only connection between the inner and outer shells may be formed as a result of the dampener assemblies. In an alternate embodiment, the inner and outer shells may be further connected to each other so as to secure the inner shell to the outer shell while permitting rotational and translational movement upon impact. As an illustrative example, complementary hook and loop fasteners, snaps, magnets, and other connection means may be employed in regions of the shells such as along portions of the perimeter of the inner and outer shells. In other embodiments, the inner and outer shells may be engaged in close contact with each other via force-fit or similar arrangement. One of ordinary skill in the art would appreciate that there are numerous methods for fitting the outer shell together with the inner shell, and embodiments of the present invention are contemplated for use with any such method of connection.

According to an embodiment of the present invention, the protective helmet is designed to reduce the force of an impact incident that is transferred to the head of a wearer. In a preferred embodiment, when the outer surface of the outer shell of the protective helmet sustains an impact force, the force of the impact causes the outer shell to move. In the preferred embodiment, the dampener assemblies between the inner and outer shells absorb the energy or force generated by the impact, thereby reducing the amount of rotational acceleration transmitted to the inner shell. The dampener assemblies enable the protective helmet to absorb the energy of an impact by allowing the outer shell to move independently from inner shell. In the preferred embodiment, this is facilitated as the dampener securing element is allowed to rotate and flex within the center of the dampener. The energy of an impact may be further reduced by padding on the interior of the inner shell, thereby minimizing the amount of force transmitted to the wearer's head. After the impact has been absorbed, the dampener assemblies return to their resting position, thus realigning the inner and outer shells. In some embodiments, the system and apparatus described herein may be retrofitted to an existing protective helmet.

Exemplary Embodiment

According to an embodiment of the present invention, the protective helmet may be configured as a football helmet. The protective helmet is not limited to a football helmet application, as other applications may include but are not limited to other sports (including, but not limited to baseball, hockey, skiing and similar winter sports, and lacrosse), extreme sports (including, but limited to skateboarding, mountain biking, and rock climbing), motorsports, and military and police application, or any application where a protective helmet is used or required. One of ordinary skill in the art would appreciate that the protective helmet of present invention would be useful in a variety of applications, and embodiments of the present invention are contemplated for use with any such application.

Turning now to FIG. 1, a perspective view of a protective helmet, in accordance with an embodiment of the present invention. In a preferred embodiment, the protective helmet 100 is comprised of an inner shell 102, an outer shell 112, one or more dampener assemblies 118, and a protective accessory 130. As an illustrative example, the protective helmet 100 is configured as a football helmet, where the protective accessory 130 is a standard football facemask that is held onto the protective helmet 100 by the accessory attachment means 128.

Figure 2:
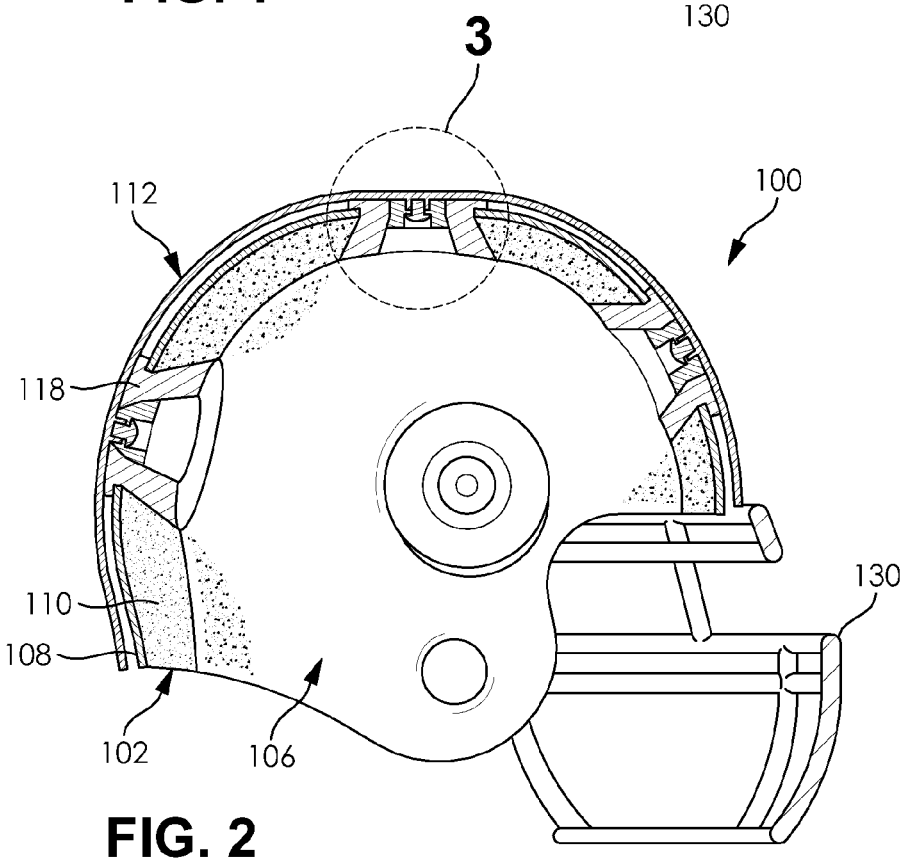
FIG. 2 is an cross-sectional view of a protective helmet in accordance with an embodiment of the present invention.

Turning now to FIG. 2, a cross section view of a protective helmet, in accordance with an embodiment of the present invention. In a preferred embodiment, the protective helmet 100 is comprised of an inner shell 102, an outer shell 112, one or more dampener assemblies 118, and a protective accessory 130. The inner shell 102 of the protective helmet 100 forms a first cavity 106 that is adapted to receive the head of the helmet wearer, while the outer shell 112 forms a second cavity that is adapted to receive the first shell 102. Furthermore, the inner shell 102 may be further divided into an inner shell covering 108, which may be made of plastic or similar material, and an inner core 110, which may be made of a foam or similar material. This covering shell 108 forms the exterior surface of the inner shell 102 by covering the inner core 110 of the inner shell 102. The inner core 110 of the inner shell 102 forms the interior surface of the inner shell 102.

Figure 3:
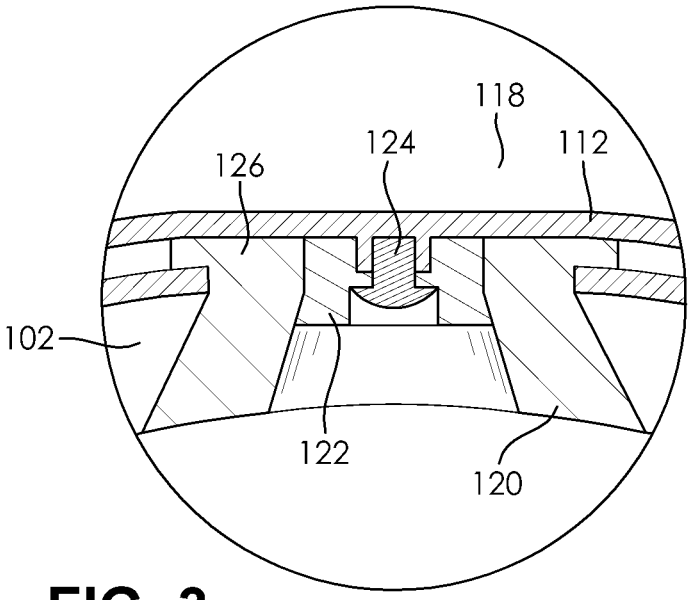
FIG. 3 is a zoomed in view of a dampener assembly of a protective helmet, in accordance with an embodiment of the present invention.

Turning now to FIG. 3, a zoomed in view of a dampener assembly of the protective helmet, in accordance with an embodiment of the present invention. In a preferred embodiment, the dampener assembly 118 is comprised of a dampener 120, a dampener securing element 122, and a fastener means 124. In the preferred embodiment, a portion of the dampener 120 extends through the dampener receiving means to create a cushion 126 between the inner shell 102 and the outer shell 112 out the protective helmet. To secure the inner shell 102 to the outer shell 112, typically the dampener 120 is first inserted through the inner shell 102. A portion of the dampener 120 may rest on the exterior surface of the inner shell 102 in order to create a cushion 126 between the interior surface of the outer shell 112 and exterior surface the inner shell 102. Next, the outer shell 112 of protective helmet will be placed over and aligned with the inner shell 102. When the outer shell 112 and inner shell 102 are properly positioned, the dampener securing element 122 can be inserted into center of the dampener 120 so that the dampener securing element 122 can join with the attachment point on the interior surface of the outer shell 112. With the dampener securing element 122 in place, the fastening means 124 can be inserted through the dampener securing element 122 and into the attachment point on the outer shell 112. The fastening means 124 firmly secures the components of the dampener assembly 118 together and further provides a solid connection between inner shell 102 and the outer shell 112.

Referring to FIGS. 2-3, when the inner shell 102 is fitted in the outer shell 112, each dampener securing element 122 is situated in an opening formed in the center of each dampener 120 of the dampener assembly 118. Furthermore, each attachment point on the outer shell 112 is also aligned with the center of a dampener 120 and the dampener securing element 122. This arrangement allows for the fastening element 124 to pass through the center of the dampener securing element 122 and connect with the attachment point on interior surface of the outer shell 112, thereby securing the inner shell 102 to the outer shell 112 through the fit created between the dampener 120 and the dampener securing element 122. The fit between the dampener 120 and the dampener securing element 122, as well as the materials from which those components are made, enable the dampener securing element 122 to move translationally, as well as rotatably, within the dampener 120. The dampener securing elements 122 are formed and operable to interact with the complementary dampeners 120. Regardless of the shell (102 or 112) on which the dampener assemblies 118 are located, the dampener securing elements 122 and the dampeners 120 are disposed such that they are formed, situated and operable to interact with each other. One of ordinary skill in the art would appreciate that one or more dampener assemblies 118 may be disposed between the inner shell 102 and the outer shell 112 of the protective helmet 102. Furthermore, while the dampener assemblies 118 are depicted as cylindrical components having a generally round shape, the dampener assemblies 118 may be any shape adequate to enable translational and rotational movement between the dampener 120 and the dampener securing element 122.

Figure 4:
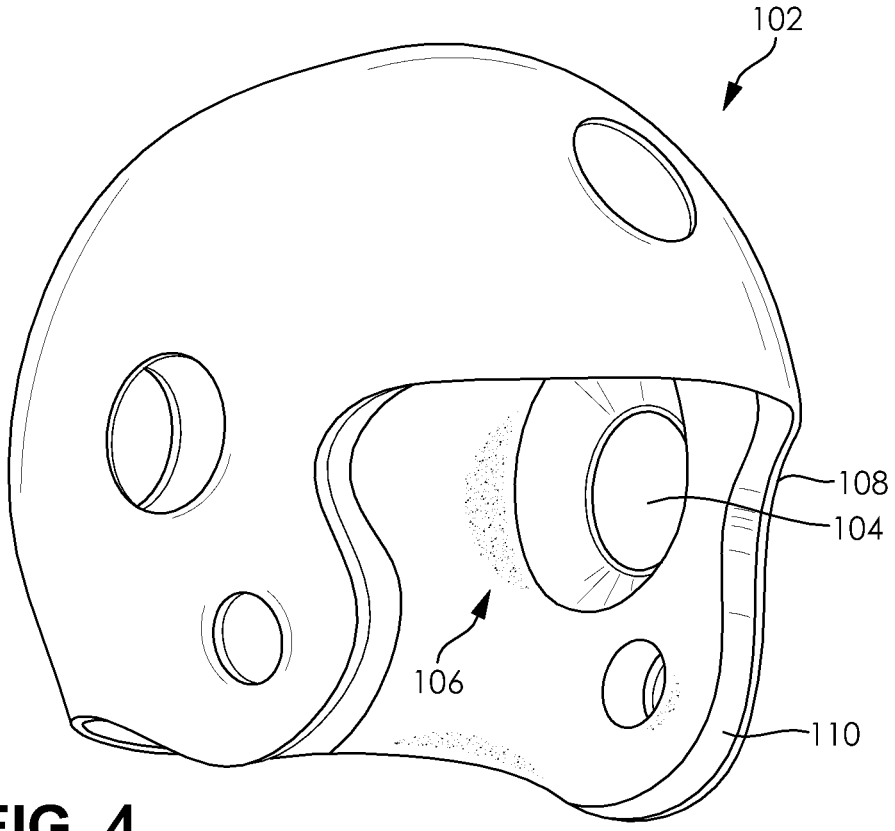
FIG. 4 is a front perspective view of the inner shell of a protective helmet in accordance with an embodiment of the present invention.

Turning now to FIG. 4, a perspective view on the inner shell of the protective helmet, in accordance with an embodiment of the present invention. In a preferred embodiment of the present invention, the inner shell 102 is configured with a dampener receiving point 104, a first cavity 106, a covering shell 108, and an inner core 110. In the preferred embodiment, the dampener receiving point 104 is configured to receive a dampener assembly (not shown), while the inner core 110 is configured to provide a semi-rigid structure to the inner shell 102 and the covering shell 108 provides a durable coating to inner core 110.

Figure 5:
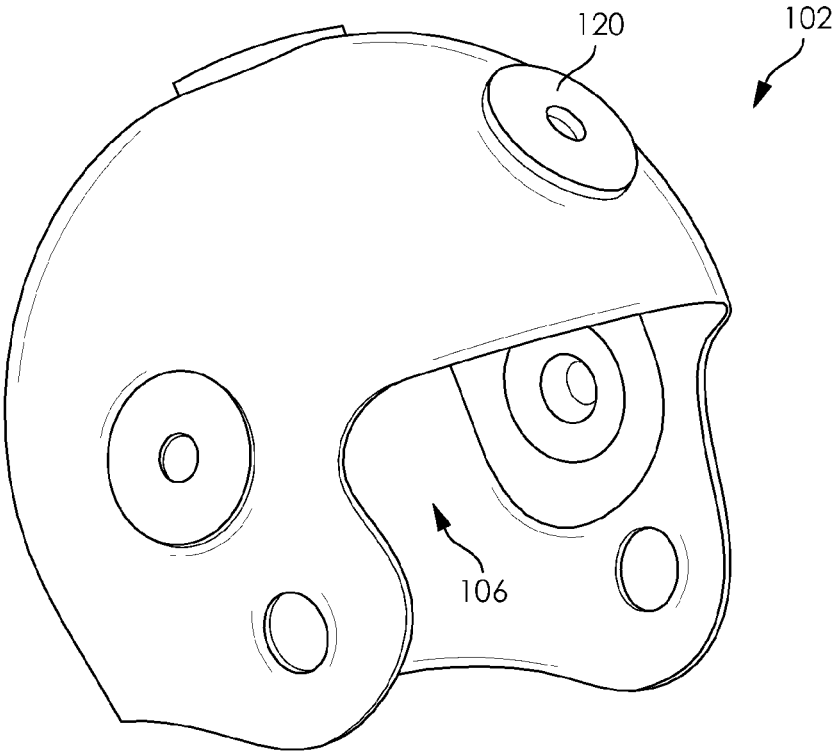
FIG. 5 is a front perspective view of the inner shell of a protective helmet in accordance with an embodiment of the present invention, in which dampeners have been inserted to the inner shell.

Turning now to FIG. 5, a perspective view of the inner shell of the protective helmet, in accordance with an embodiment of the present invention. In a preferred embodiment of the present invention, the inner shell 102 forms a first cavity 106 that is configured to receive a dampener 120 at each of the dampener receiving points on the inner shell 102. In the preferred embodiment, the dampener 120 is configured to extend through the dampener receiving point to the exterior surface of the inner shell 102.

Figure 6:
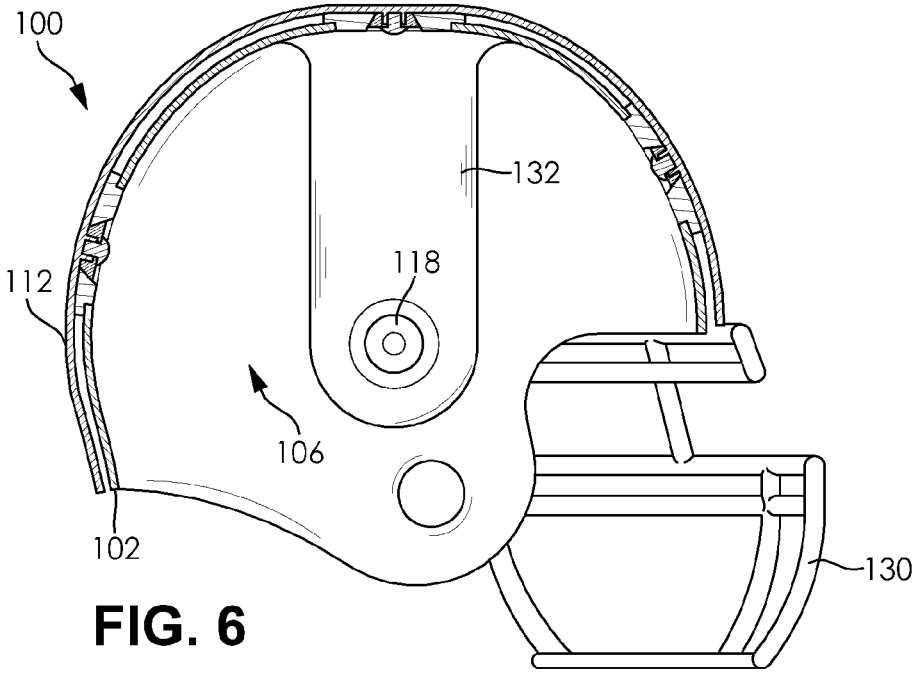
FIG. 6 is an cross-sectional view of a protective helmet with a dampener assembly sleeve in accordance with an embodiment of the present invention.

Turning now to FIG. 6, a cross section view of a protective helmet, in accordance with an embodiment of the present invention. In a preferred embodiment, the protective helmet 100 is comprised of an inner shell 102, an outer shell 112, one or more dampener assemblies 118, and a protective accessory 130. The inner shell 102 of the protective helmet 100 forms a first cavity 106 that is adapted to receive the head of the helmet wearer, while the outer shell 112 forms a second cavity that is adapted to receive the first shell 102. In some embodiments of the present invention, the one or more dampener assemblies 118 may be connected by a dampener assembly sleeve 132 that fits on the interior surface of the inner shell 102.

Figure 7:
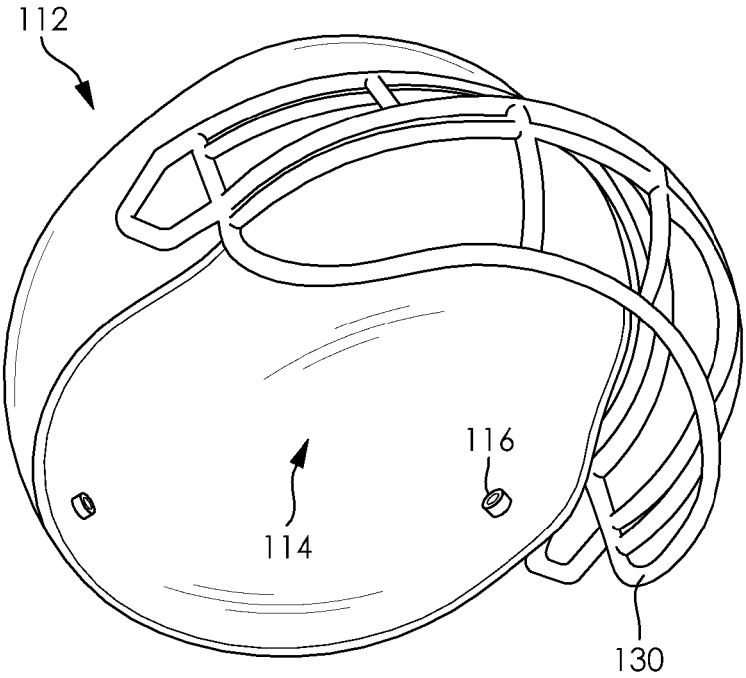
FIG. 7 is an bottom perspective view of the outer shell of a protective helmet in accordance with an embodiment of the present invention, in which the attachment points are plainly visible on the interior surface of the outer shell.

Turning now to FIG. 7, a bottom view of the outer shell of a protective helmet, in accordance with an embodiment of the present invention. In a preferred embodiment, the outer shell 112 forms a second cavity 114 that is adapted to receive the inner shell (not shown). The preferred embodiment of the outer shell 114 further includes one or more attachment points 116 on the interior surface of the outer shell 112, as well as a protective accessory 130. In the preferred embodiment, the attachment points 114 are posts that extend from the interior surface of the outer shell 112. Each of the posts that form the attachment points 114 aligns with one of the dampener receiving points on the inner shell (not shown) when the two shells are connected.

Figure 8:
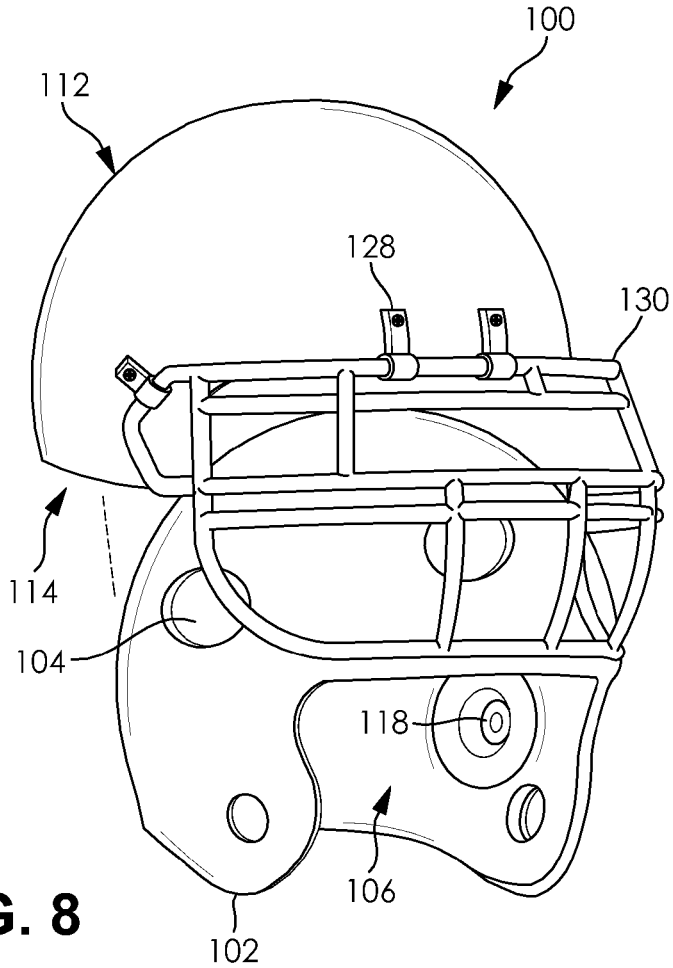
FIG. 8 is perspective view a protective helmet in accordance with an embodiment of the present disclosure, in which the outer shell is being positioned over top of the inner shell.

Turning now to FIG. 8, a view where the outer shell and the inner shell of the protective helmet are separated, in accordance with an embodiment of the present invention. In a preferred embodiment, the second cavity 114 of the outer shell 112 is adapted to receive the inner shell 102 of the protective helmet 100. This may be accomplished by connecting the outer shell 112 over top of the inner shell 102 so that the attachment points (not shown) on the outer shell 112 align with the dampener assemblies 118 and dampener receiving points 104 on the inner shell 102. Typically, the dampeners (part of 118) of the dampener assembly 118 will already be in place on the inner shell 102. Once the outer shell 112 has been placed over the inner shell 102 the dampener securing element (not shown) and the fastening means (not shown) can be inserted into the dampener (part of 118) on the dampener securing element 118 to firmly secure the outer shell 112 to the inner shell 102. In addition to the above, a protective accessory 130 (such as a facemask) may be secured to the outer shell 112 by one or more accessory attachment means 128. Once all of the components are secured in place, the protective helmet 100 is prepared to receive the wearer's head at the first cavity 106 which is formed by the inner shell 102.

Although the systems and apparatus of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and apparatus may be made without departing from the spirit or scope of the present disclosure. Accordingly, such changes, modifications, enhancements and/or refinements are encompassed within the scope of the present invention. Furthermore, the drawings and descriptions are to be regarded as illustrative in nature and not restrictive.

What is claimed is:

1. A protective helmet, comprising:

an inner shell comprising a frontal zone, a left zone, a right zone, a rear zone, and a top zone that collectively define a first cavity formed on an interior surface of said inner shell that is adapted to receive a head of a wearer and said inner shell further comprising one or more dampener assemblies each disposed within a dampener receiving point formed in one or more of said zones, wherein each of said dampener assemblies individually extends through said inner shell at one of said dampener receiving points; and an outer shell forming a second cavity adapted to receive said inner shell and comprising one or more attachment points formed as posts that are dispersed on and extend from an interior surface of outer shell without extending through an exterior surface of said outer shell, wherein each of said attachment points corresponds to one of said dampener receiving points formed in said inner shell; and a dampener, wherein a portion of said dampener extends between said inner shell and said outer shell to create a cushion between said inner shell and said outer shell, a dampener securing element movably engaged with said dampener to provide a pliable connection between said dampener securing element and said dampener, wherein said dampener securing element is formed with a channel passing through the center of said dampener securing element, and wherein said channel is adapted to receive a fastening means configured to affix said dampener securing element to one of said attachment points on said outer shell to allow rotational movement between said inner shell and said outer shell, wherein said rotational movement is facilitated by said cushion and said pliable connection, wherein said dampener assemblies compress to absorb an impact on said protective helmet.

2. The protective helmet of claim 1, wherein said dampener is formed as a toroidal pad with a center adapted to receive said dampener securing element.

3. The protective helmet of claim 1, wherein said inner shell is comprised of a foam inner liner and an exterior surface coating.

4. The protective helmet of claim 3, wherein said foam inner liner is comprised of closed-cell foam.

5. The protective helmet of claim 3, wherein said durable outer shell is comprised of acrylonitrile butadiene styrene.

6. The protective helmet of claim 1, wherein said inner shell and said outer shell are removably fitted together.

7. The protective helmet of claim 1, further comprising a protective accessory, wherein the protective accessory is a facemask or visor.

8. The protective helmet of claim 7, wherein said outer shell is further comprised of an accessory attachment means adapted to connect said protective accessory to an exterior surface of said outer shell.

9. A protective helmet, comprising:

an inner shell comprising a frontal zone, a left zone, a right zone, a rear zone, and a top zone that collectively define a first cavity formed on an interior surface of said inner shell that is adapted to receive a head of a wearer and said inner shell further comprising one or more dampener assemblies each disposed within a dampener receiving point formed in one or more of said zones, wherein each of said dampener assemblies individually extends through said inner shell at one of said dampener receiving points; and an outer shell forming a second cavity adapted to receive said inner shell and comprising one or more attachment points dispersed on an interior surface of outer shell, wherein each of said attachment points corresponds to one of said dampener receiving points formed in said inner shell; and a dampener, wherein a portion of said dampener extends between said inner shell and said outer shell to create a cushion between said inner shell and said outer shell, a dampener securing element movably engaged with said dampener to provide a pliable connection between said dampener securing element and said dampener, wherein said dampener securing element is formed with a channel passing through the center of said dampener securing element, and wherein said channel is adapted to receive a fastening means configured to affix said dampener securing element to one of said attachment points on said outer shell to allow rotational movement between said inner shell and said outer shell, wherein said rotational movement is facilitated by said cushion and said pliable connection, wherein said dampener assemblies compress to absorb an impact on said protective helmet and are connected by a dampener assembly sleeve that fits inside said inner shell.

* * * * *